US005184787A

United States Patent [19]

Holzinger et al.

[11] Patent Number: 5,184,787

[45] Date of Patent: Feb. 9, 1993

[54] WINDING MACHINE FOR WINDING UP A TRAVELLING WEB

[75] Inventors: Dieter Holzinger, Herbrechtingen; Hans-Peter Sollinger, Heidenheim; Rudolf Beisswanger, Steinheim, all of Fed. Rep. of Germany

[73] Assignee: J. M. Voith GmbH, Fed. Rep. of Germany

[21] Appl. No.: 666,388

[22] Filed: Mar. 8, 1991

[30] Foreign Application Priority Data

Mar. 8, 1990 [DE] Fed. Rep. of Germany ..... 4007329

[51] Int. Cl.[5] ..... B65H 18/16

[52] U.S. Cl. ..... 242/65

[58] Field of Search ..... 242/65, 66, 67.1 R

[56] References Cited

U.S. PATENT DOCUMENTS

| | | | |
|---|---|---|---|
| 1,923,670 | 8/1933 | Henson et al. | 242/65 |
| 3,103,321 | 9/1963 | Jilek | 242/65 |
| 3,202,374 | 8/1965 | Phelps | 242/65 |
| 4,934,619 | 6/1990 | Snygg | 242/65 X |

FOREIGN PATENT DOCUMENTS

| | | |
|---|---|---|
| 0330169 | 8/1989 | European Pat. Off. . |
| 3244510 | 10/1983 | Fed. Rep. of Germany . |
| 1513694 | 2/1967 | France . |
| 1297812 | 11/1972 | United Kingdom . |

OTHER PUBLICATIONS

Voith Publication Tragtrommelroller (Jun. 20, 1973) No. 1736, 8 pages, *Maschinenmarkt* Kontaktwickelmaschine fur Blasfolien mit automatichem Rollenwechsel Wurzburg 88 (1982) 51.*

*Primary Examiner*—John M. Jillions

*Attorney, Agent, or Firm*—Ostrolenk, Faber, Gerb & Soffen

[57] ABSTRACT

A winding machine for winding a traveling web of paper or the like. A carrying drum extends across the web. A first pair of primary levers supports the pins at the end of a cylinder on which the web is to be wound. The primary levers have one end with a fork for receiving a respective journal pin of the cylinder and another end that is mounted in the region of but eccentric to the axis of the carrying drum. The primary levers swing the cylinder over approximately 90° around the carrying drum to a second position. A second pair of secondary swing levers pick up the cylinder at the second position and move it to a third position along a substantially horizontal second pathway. A first drive connected with one primary lever introduces a moment of rotation to the axis of the cylinder moving along the primary path. A sensor detects the radial position of the cylinder and a setting device adjusts the radial position of the first drive in order to align it with the cylinder. There may be a secondary drive for imparting rotation to the cylinder over the secondary path.

13 Claims, 3 Drawing Sheets

A-B

WINDING MACHINE FOR WINDING UP A TRAVELLING WEB

BACKGROUND OF THE INVENTION

The present invention relates to a winding machine for winding up a traveling web that was produced on a paper making machine or on a similar web producing machine. In particular, the invention relates to the means that drives the web receiving cylinder to rotate.

Such winding machines have a pair of spaced apart, parallel primary levers that swing together and have a common center of swing that is generally slightly eccentric with respect to the axis of rotation of the carrying drum. If the primary levers are in a vertical orientation, so that the web receiving cylinder which is inserted in the forks of the primary levers is initially above the carrying drum at its upper vertex point, then there is a slight distance between the outer surface of the cylinder and the outer surface of the carrying drum. Due to the eccentricity, this distance gradually decreases during the swinging of the primary levers in the direction of travel of the web so that after a few angular degrees the outer surfaces of the carrying drum and the cylinder contact each other. Thereafter, the cylinder or the new web package, i.e. the "reel", produced on the cylinder is frictionally driven. Frequently, the cylinder has also been brought to the correct speed of rotation by a special starting device prior to this. Along the primary path, which is around the carrying drum, the resultant reel is pressed with greater or lesser force against the outer surface of the carrying drum in order to obtain a given linear pressure and thus a certain hardness of the wound web package or reel. The linear pressure is also maintained along the secondary path of the cylinder by a corresponding pressing by means of secondary levers.

Such winding machines, also known as "Pope rollers" generally form the end section of a paper making machine and operate to bring the web of paper obtained there into reel form. However, they are also used in order to rewind a web package which had already been finished in order to produce a new web package.

In all cases, the web package should have specific properties, particularly with respect to the hardness of the reel. The hardness of the reel should decrease from a certain initial value to a final value. The decrease should, as far as possible, be uniform from the first or inner layer to the last or outer layer. It should have a specific gradient, i.e. not be too strong and not too weak. The variation in the hardness of the reel should not show sudden changes anywhere, for instance, it should not show a sudden drop.

All of the foregoing objectives have not been achieved with the prior art. Winding machines of known construction instead produce, for instance, reels in which the center is extremely hard while toward the end, i.e. approximately at 4/5ths of the diameter of the reel, there is a great decline in the hardness of the winding. This causes the first part and, therefore, the extremely hard center, to be unusable since the web is overstressed in this region and bursts, so that this part must be thrown away as waste. In the outer end region, in which the reel has not been wound sufficiently hard, there is a lateral displacement of the layers relative to each other, so that the ends of the finished reel appear uneven and the edges of the web can be easily damaged.

In general, it is desirable to pass over the primary path of the cylinder as rapidly as possible. The duration of the stay of the reel in the primary path of the cylinder is thus small as compared with the duration of the stay in the secondary path. Accordingly, only a few centimeters of the diameter of the reel are produced over the primary path. Nevertheless, these first centimeters are important. A poorly constructed center having too little or too much hardness, for example, does not permit a dependable construction of the rest of the reel. The problem is particularly serious in the case of pressure sensitive papers, for instance, no carbon papers, for which narrow limits are set for the pressing of a cylinder which is having a reel produced thereon, against the outer surface of the carrying drum.

SUMMARY OF THE INVENTION

The object of the present invention is to develop a winding machine having primary swing levers that carry the cylinder in a swing path around a carrying drum. The machine is to be designed so that the hardness of the reel of web material has the desired course from the beginning to the end of the reel, i.e. that the extreme hardness of the web in the region of the radial center as well as the sudden decline in hardness in the radial middle or radial outer regions is avoided and that the hardness of the winding is under control throughout the winding In this connection, it should be possible, if necessary, to control the hardness of the reel without the application of linear pressure between the roll which is being produced and the outer surface of the carrying drum. Furthermore, of course, the expense for machinery should be as low as possible.

A winding machine for winding a traveling web of paper, or the like, includes a carrying drum that extends across the web. A first pair of primary levers supports a cylinder on which the web is to be wound. The primary levers support the pins at the ends of the cylinder. Each primary lever has one end with a fork for receiving a respective journal pin of the cylinder and another opposite end that is mounted in the region of, but is eccentric to, the axis of the carrying drum. The primary levers swing the cylinder over an approximately 90° primary path around the carrying drum to a second position. A second pair of secondary swing lever may pick up the cylinder at the second position and moves the cylinder away from the second position through a substantially horizontal pathway to a third position.

A first drive introduces a moment of rotation to the axis of the cylinder at least along the primary path. The first drive is connected with one of the primary levers to swing together with the primary levers and the cylinder over the primary swing path around the carrying drum. A sensor detects the radial position of the spacing between the cylinder and the carrying drum. A setting device responsive to a signal from the sensor adjusts the radial position of the first drive according to the spacing between the cylinder axis and the carrying drum axis. This provides compensation to counteract forces other than the moment of rotation which forces would act from the drive onto the cylinder.

There may also be a secondary drive for imparting rotation to the cylinder as it moves over the secondary path.

Other objects and features of the invention are explained in further detail with reference to the drawings.

DESCRIPTION OF THE PREFERRED EMBODIMENTS

Figure 1:
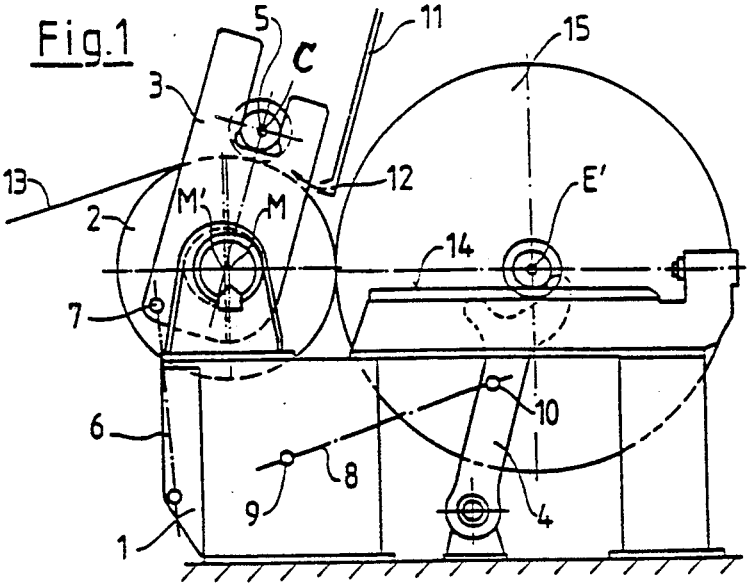
FIGS. 1 to 3 show a Pope roller in three different phases of operation upon the winding of a so-called LWC or normal paper.
Figure 2:
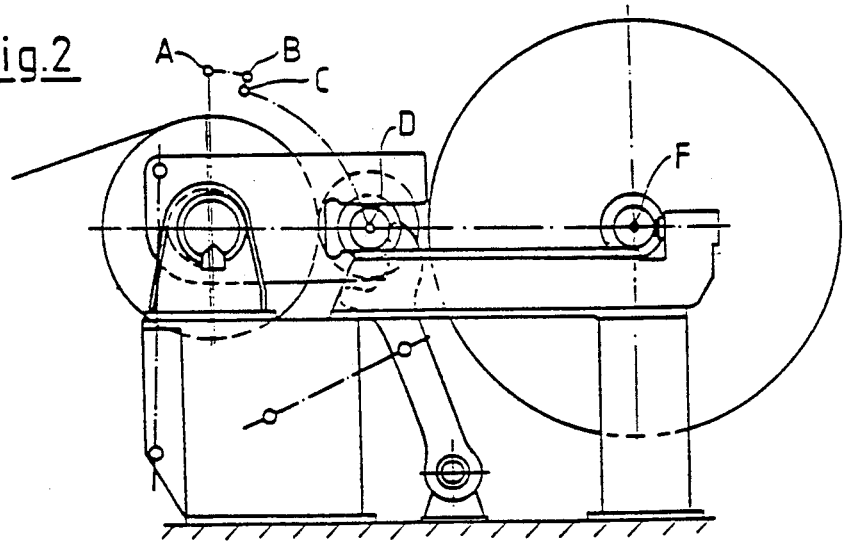
Figure 3:
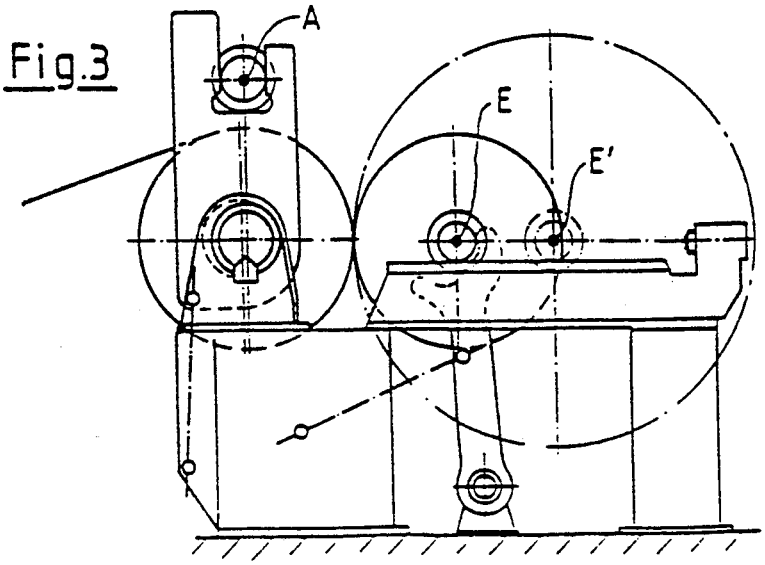

The Pope roller illustrated in FIGS. 1-3 has a machine frame 1 on which are mounted, inter alia, a carrying drum 2, two primary levers 3, and two secondary levers 4. Each of the two pairs of primary and secondary levers 3 and 4 has a fork at its upper end. The levers of a pair are spaced apart across the machine. Within each fork at each lateral side a corresponding journal pin of a cylinder 5 is received. The two primary levers 3 are parallel and locked together to move together. The levers 3 have a swing drive 6, which is indicated diagrammatically by a dot-dash line and which may in practice also comprise a pneumatic unit. The swing drive 6 acts on the primary levers 3, at an articulation 7 on the levers 3.

There is a slight eccentricity between the axis of rotation M of the carrying drum 2 and the center of swing M' of the primary levers 3. This eccentricity, however, need not be present. Due to the special development of the invention, namely the possibility of the radial positioning of the cylinder 5, the axis of rotation M of the carrying drum 2 and the center of swing M' of the primary levers 3 could also coincide.

There is a second swing drive 8 associated with the two secondary levers 4 which also are parallel and locked together to swing together. One end of the drive 8 is mounted on a bearing 9 on the machine frame 1 and the other end of the drive 8 acts on an articulation 10 on the secondary levers 4.

A blast line 11 with blast nozzles 12 serves for blowing into place to start the winding of the starting end of a web of paper 13 onto the cylinder 5.

In the machine frame 1 there is a horizontal travel path 14 on which the reel 15 is supported as it is moved along the secondary path by means of the journal pins of the cylinder 5.

Figure 4:
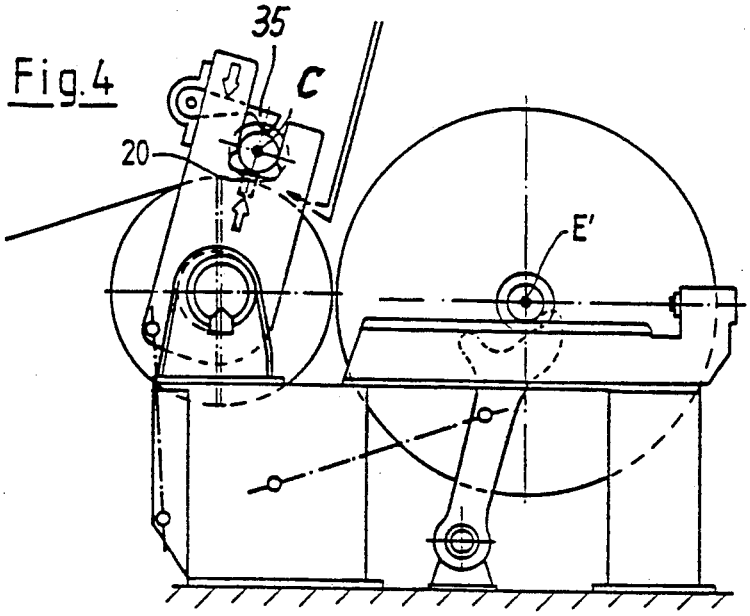
FIGS. 4 to 6 show the same Pope roller as in FIGS. 1 to 3, again in three different phases of operation, but in this case upon the winding of an NC paper.
Figure 5:
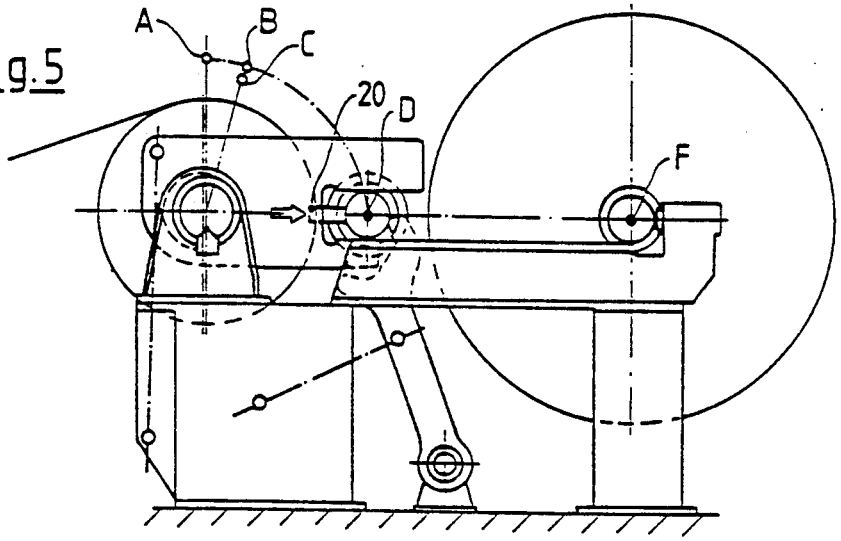
Figure 6:
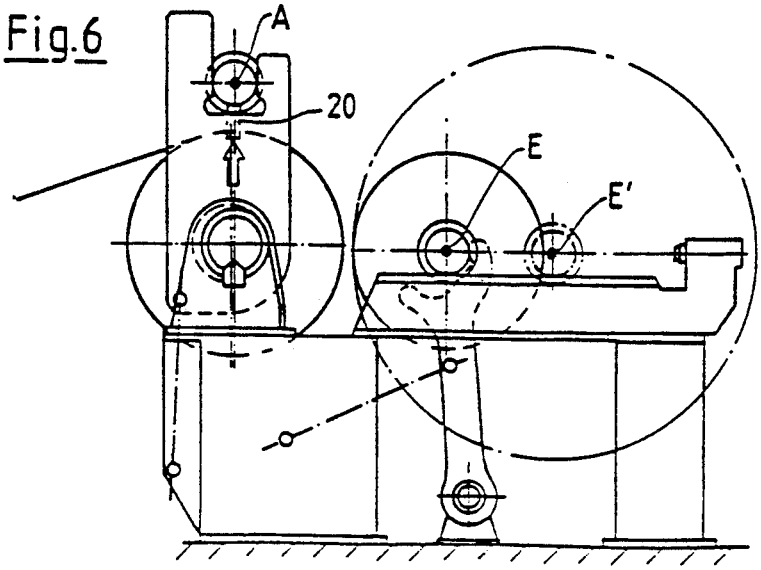

An adjusting device 20 useful in all embodiments is shown diagrammatically in FIGS. 4 to 7. It comprises a pneumatic or hydraulic unit and serves to position the cylinder 5 with respect to the carrying drum 2. A respective adjusting device is associated with each journal pin of the cylinder 5. Those devices are acted on in the direction of the arrows, as shown in FIGS. 4 to 6, in the direction of lifting of the cylinder 5 from the carrying drum 2.

Figures 7, 8:
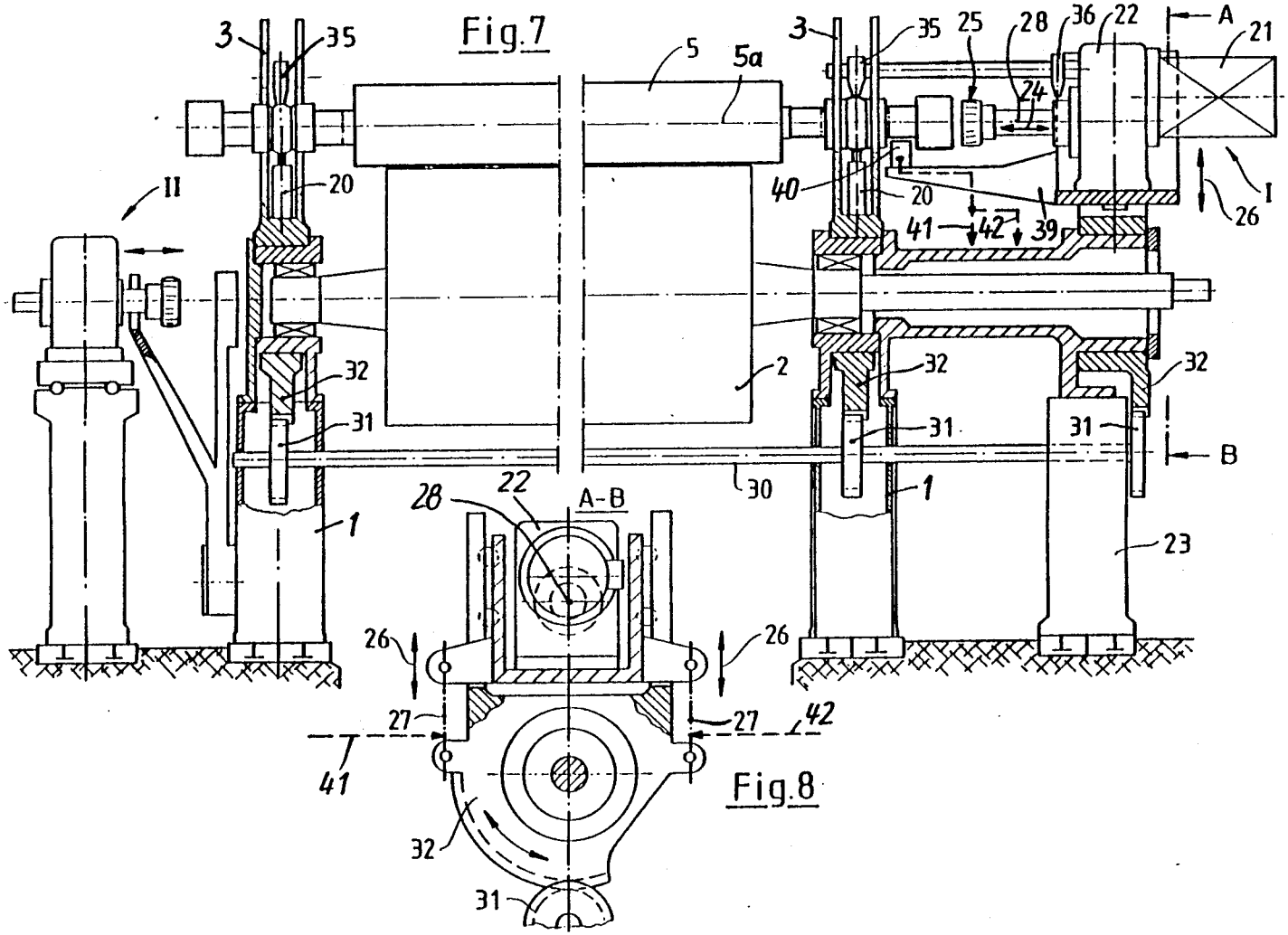
FIG. 7 shows the Pope roller in elevation, with certain parts being shown in section
FIG. 8 is a sectional view along the line A-B of FIG. 7.

FIGS. 7 and 8 show the manner in which the cylinder 5 can be driven by center drives I and II. Center drive I is mounted on its own bearing pedestal 23, which is part of the machine frame 1. Drive I has a coupling element 25, which is displaceable in the axial direction horizontally, in the direction indicated by the double ended arrow 24, so that the coupling element 25 can be brought into and out of engagement with a cylinder journal pin of cylinder 5 while, on the other hand, the drive I is displaceable vertically in the direction of the double ended arrow 26. This has the purpose of producing and maintaining at all times a precise alignment of the axis of rotation 5a of the cylinder 5 and the axis of rotation 28 of the driven coupling element 25 connected with the gearing 22.

The retention of this alignment is achieved by a sensor 40, which is arranged on the bracket 39 and is rigidly connected to the center drive I and which detects any possibly occurring distance between the axis 5a of the cylinder 5 and the axis 28 of the coupling element 25 and gives off a signal via lines 41 and 42 to a drive adjusting device 27 (see FIG. 8). This drive adjusting device suitably displaces the center drive I in the direction indicated by the double-ended arrow 26. This assures that the center drive I transmits via coupling 25 only a moment of rotation to the cylinder 5 and does not transmit forces such as, for instance, the weight of the center drive I.

Upon the swinging of the cylinder 5 with the partially wound web package present on it around the carrying drum 2, absolute synchronism of the two primary levers 3 must be assured. If the center drive I, as shown here, is mounted on its own bearing pedestal 23, then the same synchronization must also be produced with respect to the swinging motion of the center drive I. In FIGS. 7 and 8, complete synchronization is effected by a synchronization shaft 30 that has gear wheels 31 which mesh with the corresponding gear segments 32 of the two primary levers 3 and of the center drive I.

Center drive II can be provided in addition to center drive I. However, drive II is not absolutely necessary. Again, there is a mechanical coupling of the center drive II to the corresponding journal pin of the cylinder 5. As can be seen, the two center drives I and II lie on two axially different sides of the machine. For instance, the center drive I can be on the operator's side of the machine. However, placement of each drive I and II on either opposite side is possible.

Cylinder holders 35 act from above on each of the two journal pins of the cylinder 5. Their purpose is to prevent shimmying of the cylinder upon the operation of the machine. Together with the cylinder adjusting device 20, they, to a certain extent, clamp the cylinder pins fast and position them. A corresponding drive holder 36 is associated with the center drive I. In this connection, the one cylinder holder 35 and the drive holder 36 can be rigidly connected to each other.

The manner of operation of the machine is first described with reference to FIGS. 1 to 3 which winds normal papers which are not pressure-sensitive. In this connection, the individual positions of the cylinder, possibly with a started or finished reel 15 thereon, are designated by the letters A, B, C, D, E', E, F.

FIG. 1 shows the phase of operation in which a reel 15 has been finished and a new reel is to be started. Reel 15 is in the position E' while the cylinder 5 is in position C. On the path from A to B (FIG. 2), the cylinder 5 is already being driven by the center drive I and is brought to the peripheral speed of rotation of the carrying drum 2. From position B, the cylinder 5 is then lowered, i.e. moved somewhat radially inwardly, to position C (FIGS. 1 and 2) so that it comes into contact with the outer surface of the carrying drum 2 for the purpose of starting the winding up of the web 13. The starting end of the web 13, which is introduced from the left, is started to be wound onto the cylinder 5 by means of the blast nozzles 12. On its path from C via D and E to E', the reel which is now being produced is in contact with the outer surface of the carrying drum. Between B and E the center drive I also operates, as it introduces a moment of rotation into the cylinder 5. Not until the finished reel 15 has been brought into position F, the cylinder 5 with the new reel can move into position D. Until position E is reached, the roll which is being produced is driven both by frictional drive on the carrying drum 2 and by the center drive I. Only in the final phase between E and E' does the drive merely take place by application of the reel 15 against the carrying drum 2 and thus by frictional drive.

The conditions are different upon the operation of the machine in accordance with FIGS. 4 to 6. The most important feature of this manner of operation is that the reel which is being produced is never pressed against the outer surface of the carrying drum 2, except a very short moment during the start of the winding in position C. Thereafter, the cylinder 5 immediately returns to position B. From position B, the cylinder travels to position D. The tension in the web and, thus, also the hardness of the roll are controlled exclusively by the two center drives I and II.

Otherwise, these two manners of operation, for normal papers in accordance with FIGS. 1 to 3 and for pressure-sensitive papers in accordance with FIGS. 4 to 6, are shown in the following tables

| | NORMAL PAPERS (LWC) | | | |
|---|---|---|---|---|
| | | Center Circumferential | | No Center |
| | | Drive I | Drive | Drive II |
| (B) | Cylinder started in storage position | Yes | No | / |
| (C) | Cylinder change | Yes | Yes | / |
| (D) | Cylinder Transfer | Yes | Yes | / |
| (E) | Winding up to about 1.5 diam. | Yes | Yes | / |
| (E') | Final winding | No | Yes | / |

| | PRESSURE-SENSITIVE PAPERS NCR | | | |
|---|---|---|---|---|
| | | Center Circumferential | | Center |
| | | Drive I | Drive | Drive II |
| (B) | Cylinder started in storage position | Yes | No | No |
| (C) | Start of winding | Yes | Yes | No |
| (D) | Cylinder transfer | Yes | No | No |
| (E) | Winding up to about 1.5 m diam. | Yes | No | Yes |
| (E') | Final winding | No | No | Yes |

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A winding machine for winding a traveling web, comprising:

a carrying drum extending across the web;

a first pair of primary swing levers parallel and connected to swing together, each primary lever having one end including first means for receiving a cylinder on which the web is to be wound, the first receiving means being generally radially outward of the carrying drum; each primary swing lever having an other end portion away from the first receiving means, and the other end portion being in the region of the axis of the carrying drum; the primary levers being so placed that the receiving means swings the cylinder out of a first position above the carrying drum and around a primary path in the direction of travel of the web around the carrying drum to a second position, the first receiving means and the cylinder thereon being so placed with respect to the carrying drum that the end of the web is started to be wound around the cylinder while the cylinder is at the carrying drum and before the cylinder has been moved by the first receiving means to the second position;

second means for moving the cylinder over a substantially horizontal secondary guide path from the second position to a third position away from the second position;

a center drive having a coupling element which is placed for engaging the cylinder while it is in the first receiving means for introducing a moment of rotation of the cylinder around the cylinder axis while the cylinder is moving over the primary path around the carrying drum; the center drive being connected with one of the primary levers for passing along the primary path together with the primary lever;

a sensor positioned and adapted to detect any possible distance between the axis of the cylinder and the axis of the coupling element at least in the primary path; a center drive setting device connected for receiving a signal from the sensor and adaptable for aligning the cylinder axis and the axis of the coupling for compensating for forces other than the moment of rotation, which forces would act from the center drive onto the cylinder.

2. The winding machine of claim 1, wherein the second means for moving the cylinder from the second position to the third position comprises a second pair of secondary swing levers parallel and connected to swing together, including second cylinder receiving means thereon and having a second end away from the second receiving means at which the second levers are supported for swinging, the second receiving means and the secondary levers being so placed that the second receiving means move the cylinder over the secondary guide path.

3. The winding machine of claim 1, wherein the cylinder has journal pins; the machine further comprising the first receiving means each comprising a fork for receiving a respective one of the journal pins on one end of the cylinder.

4. The winding machine of claim 1, wherein the primary path of the cylinder as carried by the first receiving means is about 90° around the carrying drum.

5. The winding machine of claim 1, wherein the center drive for the cylinder comprises a motor and a transmission.

6. The winding machine of claim 1, wherein the cylinder has journal pins; the machine further comprising a cylinder setting device having a respective pneumatic device associated with a respective one of the journal pins of the cylinder on which the web is being wound.

7. The winding machine of claim 6, further comprising a cylinder holder associated with the cylinder at the respective journal pins thereof for applying a force to the journal pins that is directed against the cylinder setting device, in order to produce a linear force.

8. The winding machine of claim 1, wherein the center drive for the cylinder is movable radially of the carrying drum; the drive setting device being connected with the center drive for counteracting disturbing forces on the center drive and the cylinder.

9. The winding machine of claim 1, further comprising a mechanical coupling between the center drive and one of the journal pins of the cylinder.

10. The winding machine of claim 1, further comprising a second drive for introducing a moment of rotation on the cylinder along the secondary path.

11. The winding machine of claim 10, wherein the first drive has one end, and the second drive is at the end of the cylinder that is opposite the end at which the first drive is located.

12. The winding machine of claim 11, wherein the second drive introduces a moment of rotation on at least one pin of the cylinder.

13. The winding machine of claim 1, further comprising means for directing the web onto the cylinder to start the web winding on the cylinder while the web is at the carrying drum and substantially before the cylinder has moved through the primary path.

* * * * *